US005326184A

United States Patent [19]

Shibata

[11] Patent Number: 5,326,184

[45] Date of Patent: Jul. 5, 1994

[54] APPARATUS AND METHOD FOR PICKING PAPER FROM A STACK

[75] Inventor: Alan Shibata, Vancouver, Wash.

[73] Assignee: Hewlett-Packard Company, Palo Alto, Calif.

[21] Appl. No.: 967,079

[22] Filed: Oct. 26, 1992

[51] Int. Cl.[5] ..... B41J 13/16

[52] U.S. Cl. ..... 400/624; 400/625; 400/627; 271/119

[58] Field of Search ..... 460/629, 624, 625, 626, 460/627, 628; 271/109, 113, 37, 119, 120, 117, 118

[56] References Cited

U.S. PATENT DOCUMENTS

| | | | |
|---|---|---|---|
| 4,268,026 | 5/1981 | Kojima | 271/109 |
| 5,019,839 | 5/1991 | Watanabe et al. | 400/624 |
| 5,149,077 | 9/1992 | Martin et al. | 271/119 |
| 5,188,350 | 2/1993 | Hayashi | 271/119 |

*Primary Examiner*—Edgar S. Burr
*Assistant Examiner*—Lynn D. Hendrickson

[57] ABSTRACT

A rotatable pick engager for use with a printer for precisely timing the engagement of a paper stack with a pick roller during the picking of a sheet from the stack, greatly reducing top of sheet variability, skewing and multiple picks.

15 Claims, 4 Drawing Sheets

APPARATUS AND METHOD FOR PICKING PAPER FROM A STACK

BACKGROUND OF THE INVENTION

1. Field of the Invention

The present invention relates generally to printers such as those used in conjunction with desk top computers for example, and in particular to an apparatus and method for reliably picking a sheet from a paper stack to feeding it to a position for being printed upon by the printer.

2. Description of Related Art

Printers designed for use with word processors or general purpose computers must be capable of printing on various sizes of paper. Accordingly, printers are often designed to receive sheets of paper from one of a number of interchangeable, removable paper trays, each of which is sized to hold a particular size of paper. It naturally follows that the printer must include a mechanism for removing a sheet of paper from atop a stack held in the tray and for transporting the sheet to the required position for being printed upon. As is common among those skilled in the art, this process is referred to hereinafter as picking a sheet from the stack.

In order for the printer to accurately print text or images in the desired location on a sheet, the sheet must be accurately and consistently positioned relative to the print head. Stated another way, the picking process must be highly accurate and reproducible by delivering the sheet to exactly the same position and in the proper orientation each time. In order to do so, the sheet must be picked from the stack in a highly predictable and consistent manner. Picking mechanisms typically include a rotatable drive shaft positioned above the stack and transversely to the direction of paper travel. Two pick rollers are mounted on the drive shaft for engaging the top sheet near each longitudinal side. A pick roller is usually made from a material such as soft plastic or rubber, and includes a cam like raised surface for frictionally engaging and advancing the top sheet as the drive shaft is rotated.

Variability in the picking process takes two principal forms, top of sheet variation and skewing, each of which may arise in several ways. Top of sheet variation refers to variation in the distance a sheet is transported during picking, resulting in variation of the position of the top of the sheet relative to the printing head. Top of sheet variation may result from inconsistent engagement of the pick roller with the top sheet owing to relatively wide manufacturing tolerances or deflection of the relatively soft materials of construction. Alternatively, as shown in FIG. 1, top of sheet variability "d" may result from the change in position and/or orientation of the stack in the tray may vary as the stack is depleted, resulting in variation in the timing of engagement of the picking mechanism.

Skewing refers to the sheet being rotated during picking, and usually results from variations in the timing of engagement between the pick rollers. Tighter control of manufacturing tolerances of pick rollers reduces skewing, but cannot eliminate it entirely due to the flexible nature of the materials of construction. Skewing may be reduced in cases where the stack is supported in the tray with one end raised by a process known as gravity dancing. The top sheet of the stack is engaged at its lower end by the pick rollers and fed along a downwardly angled path and engaged by the rotating dry rollers. The dry rollers are then rotated in reverse, moving the sheet upwardly until the sheet is clear of the dry rollers. As the dry rollers continue to rotate in reverse, the sheet is straightened relative to the dry rollers by being momentarily supported against the force of gravity with its lower edge positioned at the point where the dry rollers contact an underlying platten. The dry rollers are then rotated in the forward direction, advancing the paper to the printing position. While effective, this method requires an upwardly angled paper tray, and a relatively complex picking control algorithm.

An additional problem encountered in picking is multiple picks, that is the picking of sheets underlying the top sheet. Multiple picks may occur when underlying sheets in the stack are partially "dragged" out of the tray by the picking of sheets above, and is not suitably remedied by known picking mechanisms.

A need therefore exists for an improved picking mechanism which serves to accurately and consistently position successive sheets picked from atop a paper stack for printing, and which can be economically incorporated into known printer designs.

SUMMARY OF THE INVENTION

The present invention is embodied in a pick engager for timing the engagement of a rotatable pick roller against a paper stack for picking the top sheet therefrom where the paper stack is biased towards the pick roller to a first position whereat the top sheet is frictionally engageable with the pick roller when the pick roller is rotated to a predetermined rotational position. The pick engager may comprise a body having a raised surface or a cam, and means connected to the body for rotating the pick engager for engaging the cam against the paper stack for urging the paper stack to a second position away from the pick roller until the pick roller reaches its predetermined rotational position. The means for rotating the pick engager may be a rotatable drive shaft on which the pick engager is mounted.

The body of the pick engager may have a transverse aperture for receiving the drive shaft, and may further have a raised peripheral portion, or cam, for urging the paper stack to a second position spaced apart from the pick roller when the pick engager is rotated by the drive shaft. The pick engager may be rotatable about the drive shaft from a first rotational position to a second rotational position relative to the drive shaft for releasing the paper stack to its first biased position for engaging the top sheet with the pick roller when the pick engager is rotated to a predetermined position. The pick engager may be rotated to its second rotational position by a force exerted on the pick engager by the paper stack. The raised peripheral portion of the pick engager may alternatively include a roller for rollingly engaging the paper stack when the pick engager is rotated by the drive shaft.

The present invention may also be embodied in an apparatus for picking a top sheet from atop a paper stack comprising a rotatable drive shaft, a pick roller drivably connected to the drive shaft and having a peripheral surface for frictionally engaging the stack for picking the top sheet therefrom when rotated by the drive shaft, urging means such as a spring for biasing the paper stack toward a first position where the top sheet is frictionally engageable with the pick roller when the pick roller is rotated, and one or more pick engagers as described above drivably connected to the drive shaft.

The present invention may further be embodied in a printer comprising means for forming an image on a sheet, such as a printer head, means such as a tray for supporting a paper stack, and means for picking a first sheet from the stack, such as the apparatus for picking a top sheet from atop a paper stack just described.

The present invention is embodied in a method of picking a sheet of paper from a paper stack, whatever the apparatus employed, comprising the steps of biasing the paper stack towards a rotatable pick roller to a first position where a first sheet of the paper stack is frictionally engageable by the pick roller, urging the paper stack to a second position spaced apart from said pick roller, rotating said pick roller to said predetermined rotational position, and releasing said paper stack to said biased first position for frictionally engaging said top sheet with said pick roller for picking said top sheet from the stack. The steps of urging the paper stack to its second position and releasing said paper stack to its biased first position may comprise the steps of providing a rotatable drive shaft having one or more pick engagers mounted thereon as described above.

The step of releasing said paper stack to its biased first position may include the steps of rotating the drive shaft and engaging the raised peripheral surface of the pick engager against the paper stack and urging the paper stack to its second position, rotating the pick roller to the predetermined picking position, and rotating the pick engager about the drive shaft to its second rotational position for disengaging the raised peripheral surface from the paper stack, thereby releasing the paper stack to its first biased position and engaging the pick roller with the top sheet of the paper stack. The step of rotating the pick engager about the drive shaft to its second rotational position may include urging the paper stack against the pick engager to exert a rotating force thereon.

The apparatus and method of the present invention will now be described in greater detail with reference to the figures.

DETAILED DESCRIPTION OF THE PREFERRED EMBODIMENT

Figure 3:
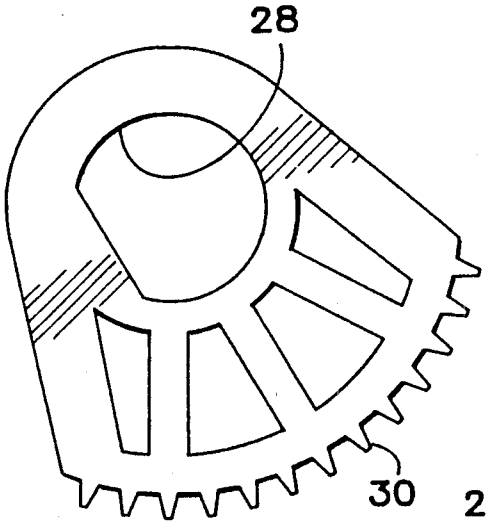
FIG. 3 shows a side cross-sectional view of a pick roller.

Referring to FIGS. 2–5, a pair of pick engagers 10 according to the present invention are shown at 10, each mounted on a shaft 12 adjacent to a pick roller 14 (FIG. 3). Shaft 12 in turn is mounted in a printer (not shown) transversely above a paper tray 16 containing a paper stack 18. As best seen by reference to FIG. 6, shaft 12 has a flat portion 13 formed in its periphery, the significance of which will be further described below. Shaft 12 is rotated by known means in response to a signal to pick a sheet.

Figure 1:
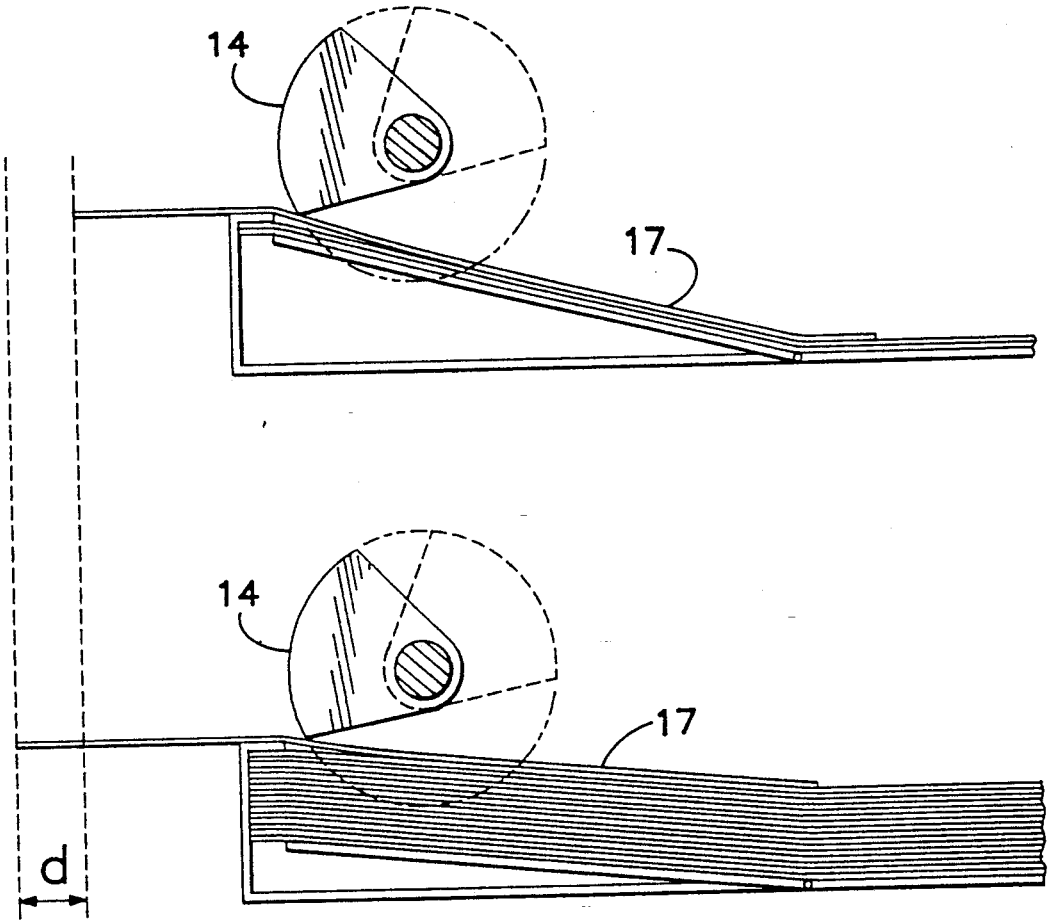
Fig. 1 PRIOR ART
FIG. 1 is a schematic side view of a prior art picking mechanism showing top of sheet variability with varying stack height.
Figure 2:
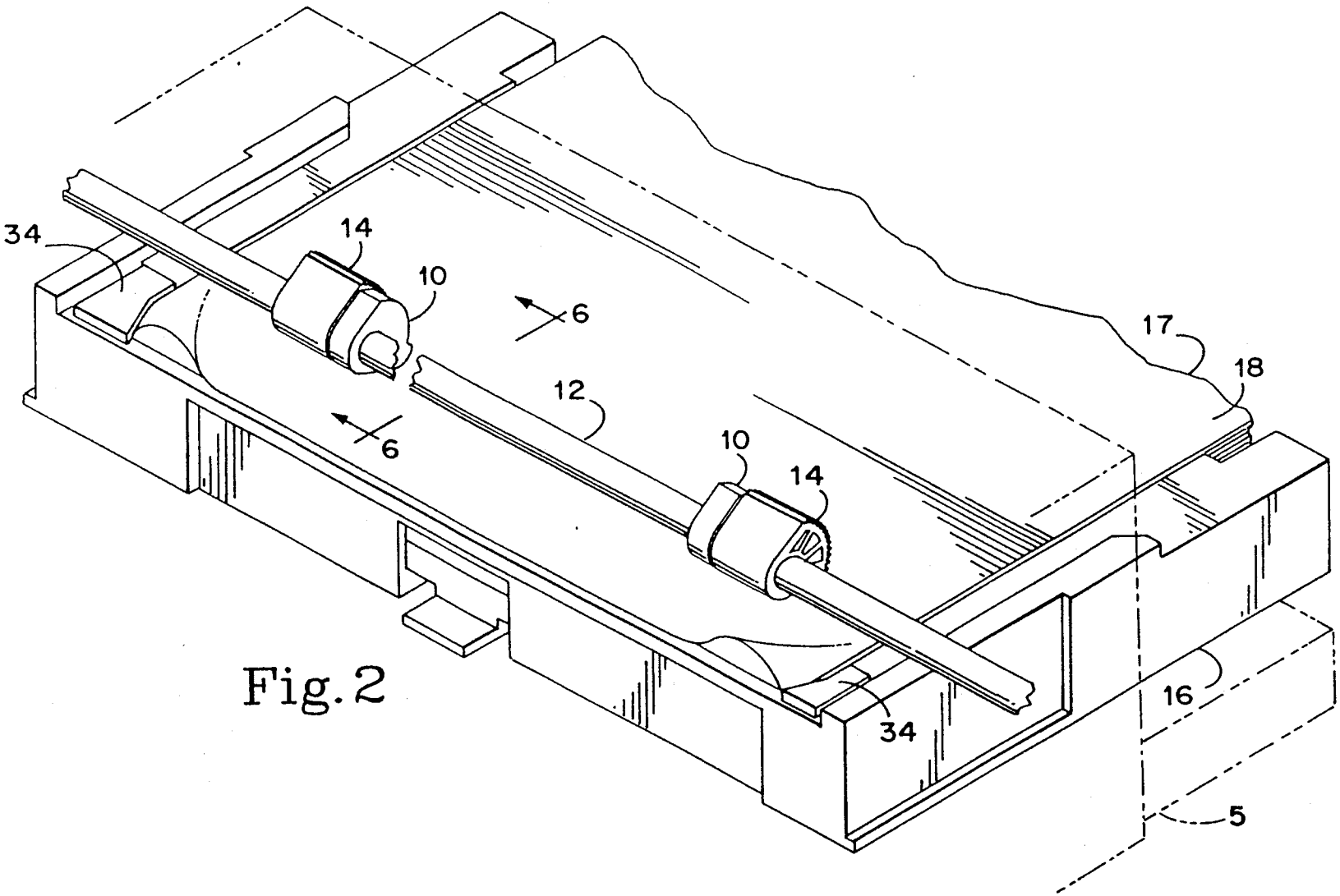
FIG. 2 is a perspective view showing a pick engager according to the present invention in position for picking a sheet from a paper stack in a tray.
Figure 5:
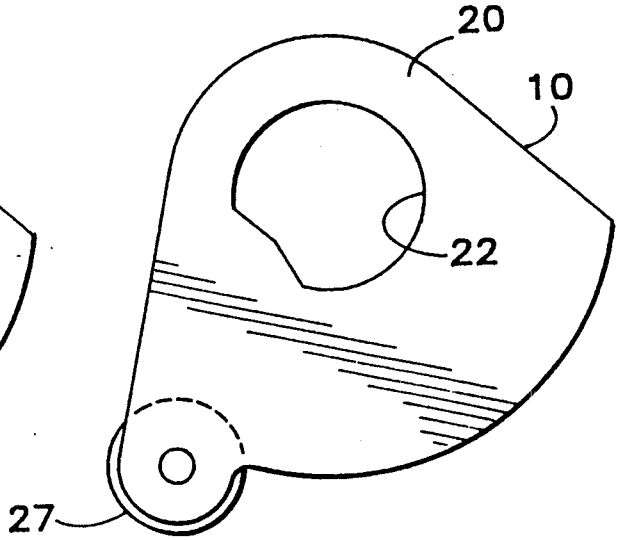
FIG. 5 is a side cross-sectional view of an alternative embodiment of a pick engager according to the present invention.
Figure 4:
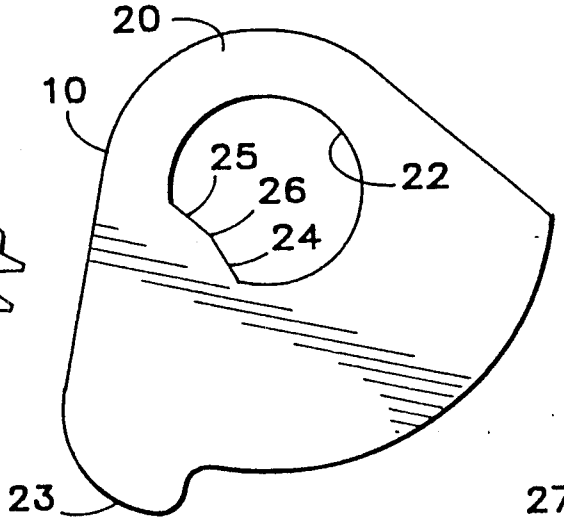
FIG. 4 is a side cross-sectional view of the preferred embodiment of a pick engager according to the present invention.

Turning to FIG. 4, pick engager 10 can be seen in side cross-section to include a base portion 20 having an aperture 22 formed therein, and having a cam 23 formed on its outer peripheral surface. Aperture 22 is sized to closely receive shaft 12 for mounting pick engager 10 thereon, and includes first and second flat surfaces 24 and 25 which meet to form a fulcrum 26. The orientation of surfaces 24 and 25 allows pick engager to be rocked back and forth about fulcrum 26 between first and second respective rotational positions on shaft 12 in response to forces exerted on pick engager 10 by shaft 12 and paper stack 18 during operation as will be further described below. Pick engager is preferably formed from Delrin-AF, a teflon® impregnated polymeric resin manufactured by E. I. DuPont de Nemours and Co. It will be appreciated that other materials having suitable strength and suitably low friction coefficients to ensure proper operation as described below may be substituted.

Each pick roller 14 may be described as having a sector-like shape when viewed from the side as shown in FIG. 3. Aperture 28 is provided for mounting the pick roller in a fixed rotational position on shaft 12. Note that aperture 28 does not include a fulcrum such as the one provided in aperture 22 through pick engager 10, and pick roller 14 is therefore maintained in a fixed rotational position on shaft 12. Pick roller 14 includes a toothed surface 30 for frictionally engaging the top sheet of the paper stack when the pick roller is rotated by shaft 12. Pick roller is preferably made of a rubber such as EPDM, which is preferred for its combination of toughness, resilience and flexibility which allows toothed surface 30 to deform slightly as it engages the top sheet of the stack.

Figure 6:
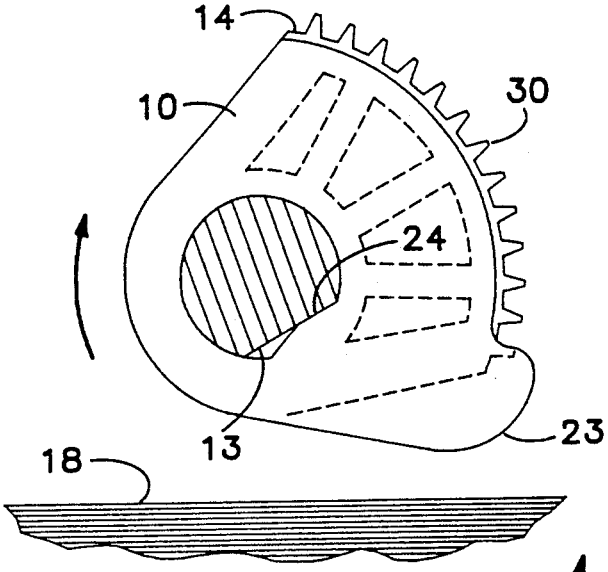
FIGS. 6–9 are successive side cross-sectional views of a picking mechanism which demonstrate the method of the present invention.
Figure 7:
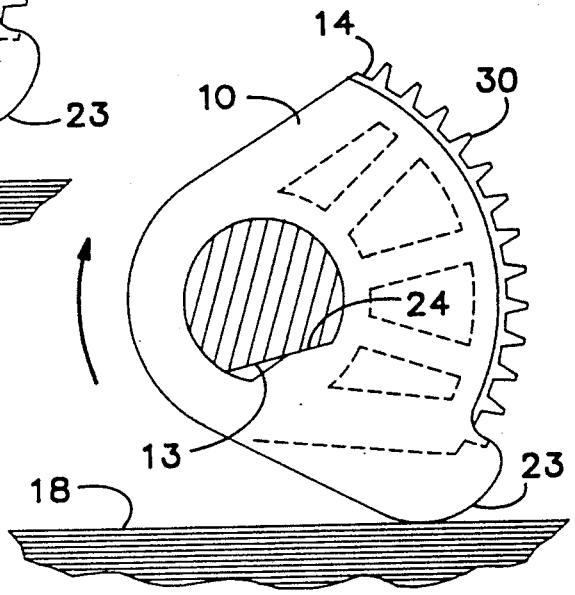

The method and operation of the apparatus of the present invention are best described by reference to FIGS. 6–9, where pick roller 14 (in phantom) and pick engager 10 are shown in cross-section mounted next to one another on shaft 12. Note that cam 23 of pick engager 10 extends beyond toothed surface 30 of pick roller 14. Prior to being engaged by pick engager 10, stack 18 is biased upwardly within its tray (not shown) to a first position where the top sheet of the stack is urged against the underside of retaining lips 34 (FIG. 2) by a spring mechanism within the tray (not shown), one or more operative designs for which are known to those skilled in the art. Prior to beginning a picking cycle, shaft 12 is positioned so that pick roller 14 and pick engager 10 are disengaged from the stack 18 as shown in FIG. 6. Moreover, pick engager 10 is in what shall be referred to as its rearward position on shaft 12, that is, with surface 24 in contact with flat 13 of shaft 12.

Figure 8:
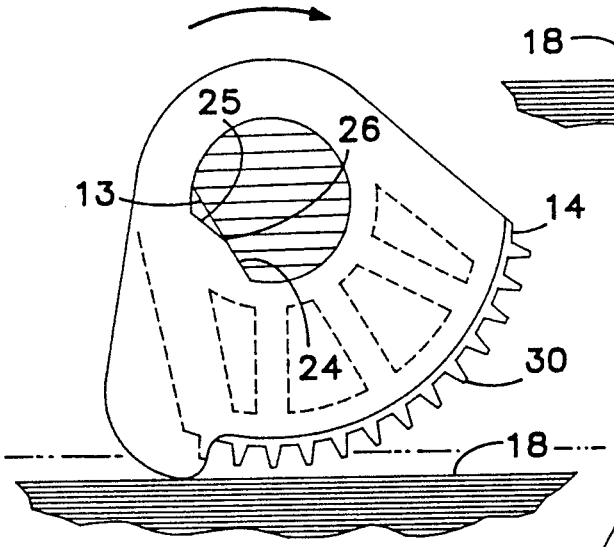
Figure 9:
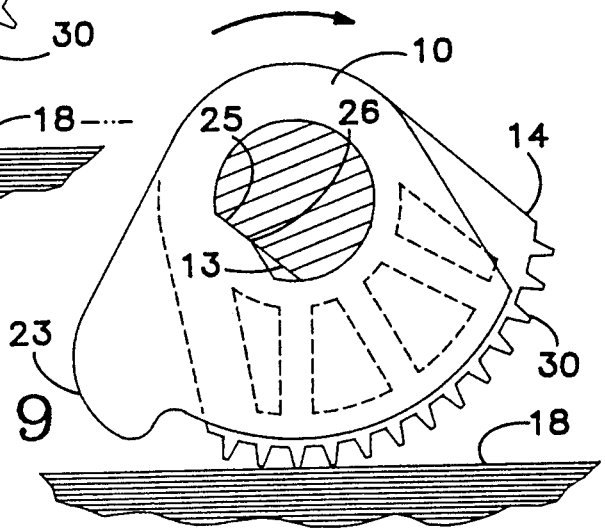

Upon initiation of a picking cycle by the printer, shaft 12 is rotated forward, or clockwise. The cam 23 of pick engager 10 engages stack 18 ahead of pick roller 14 (FIG. 7), and the teflon-impregnated peripheral surface 23 of the pick engager slides across the top of stack 18 while the top sheet remains in place atop the stack. In an alternative embodiment shown in FIG. 5, a roller 27 is incorporated in cam 23 to provide for rolling engagement of stack 18 instead of the sliding engagement provided by the preferred embodiment. As shaft 12 continues to rotate, stack 18 is displaced downwardly within the tray by pick engager 10 (FIG. 8). This action of pick engager 10 serves two purposes. First, stack 18 is displaced downwardly to prevent premature engagement of pick roller 14 with the stack. Second, multiple picking is avoided by ensuring that the upper sheets of the stack, and their corners in particular, remain beneath retaining lips 34 until the sheet is intended to be picked. As mentioned above, the unintended picking of multiple sheets can be caused by sheets underlying the top sheet being partially dragged from the tray as a result of the frictional drag exerted on them by the top sheet as it is picked. Multiple picks are more likely to occur when the corners of one or more upper sheets in the stack have been pulled out from beneath retaining lips 34 by prior picks. The downward stack displacing action of pick engager 10 serves to return any such exposed corners to their position beneath retaining lips, reducing the chances that a multiple pick will occur.

As shaft 12 is rotated and pick engager 10 is bearing on and downwardly displacing stack 18, the stack is exerting an equal reaction force upwardly on pick engager 10 through the point of contact 36 with cam 23 according to well-known physical principals. During the portion of the picking cycle when the point of contact is to the right of fulcrum 26 as viewed in FIGS. 5 and 6, the reaction force exerted by the stack is manifest as a counterclockwise torque holding surface 24 firmly against flat 13 and pick engager 10 in its rearward position on shaft 12. As shaft 12 is turned farther, however, the point of contact 36 moves to the left of fulcrum 26, and the torque on pick engager 10 is reserved, causing pick engager 10 to rotate clockwise about shaft 12 to its forward position with surface 25 against flat 13. Peripheral surface 23 and fulcrum 26 are position relative to one another so that as pick engager is thus rotated to its forward position, peripheral surface 23 disengages from stack 18. Stack 18 then is then urged upwardly into engagement with pick roller 14 by the spring mechanism in the tray containing stack 18. Shaft 12 is rotated further, and the top sheet of stack 18 is frictionally engaged and transported from atop the stack by toothed surface 30 of pick roller 14, and is transported into position for being printed upon by other mechanisms incorporated the printer and known to those skilled in the art.

Owing to the close manufacturing tolerances which can be achieved with the material from which pick engager 10 is made, and its rigidity under the reaction force exerted by stack 12, the timing of the release of stack 18 into engagement with pick roller 14 can be controlled much more closely than has heretofore been possible. Closer control of the timing of the engagement of pick roller 14 provides a corresponding reduction in top of sheet variation and skewing during picking. In addition, the occurrence of multiple picks is greatly reduced. All of these advantages together result in enhanced printer reliability, and are achieved with the addition of a minimum number of inexpensive components requiring little if any redesign of existing printers. In many cases, a pick engager according to the present invention may be incorporated into existing printer designs without any modification of existing components.

While the present invention has been described with reference to the preferred embodiment, it will be appreciated that numerous modifications are possible without departing from the scope of the following claims.

I claim:

1. A rotatable pick engager for use with and for timing the engagement of a rotatable pick roller against a stack of sheets biased towards the pick roller when the pick roller is rotated to a predetermined stack engaging position, the pick engager comprising:

a body having a peripheral surface, said peripheral surface including a raised portion adapted for periodically urging the stack away from the pick roller when said pick engager is rotated;

a transverse aperture formed in said body for drivably receiving a rotatable drive shaft;

said body adapted for being reversibly rotatable about said drive shaft from a first rotational position for urging the stack away from the pick roller to a second rotational position relative to said drive shaft to release the stack into engagement with the pick roller when the pick roller is rotated to its stack engaging position.

2. A pick engager according to claim 1 wherein said drive shaft includes a flat peripheral surface, and wherein said transverse aperture has a first surface adapted for engaging said flat peripheral drive shaft surface when said pick engager is in its first rotational position relative to said drive shaft, and has a second surface adapted for engaging said flat peripheral drive shaft surface when said pick engager is in its second rotational position relative to said drive shaft.

3. The pick engager of claim 1 wherein said pick engager is rotatable to said second rotational position relative to the drive shaft in response to a force exerted on said pick engager by the stack.

4. The pick engager of claim 1 wherein said raised peripheral portion includes a roller for rollingly engaging the stack when said pick engager is rotated by the drive shaft.

5. An apparatus for picking a top sheet from atop a stack of sheets comprising:

a rotatable drive shaft;

a pick roller drivably connected to said drive shaft and having a peripheral surface for engaging stack of sheets when said pick roller is rotated to a stack engaging position by said drive shaft;

urging means for urging the stack toward a first position whereat the top sheet is frictionally engageable with the pick roller when the pick roller is rotated to said stack engaging position;

a pick engager drivably connected to said drive shaft, said pick engager including a body having a transverse aperture for drivably receiving the rotatable drive shaft, and further including a peripheral surface having a raised portion for periodically urging the stack away from the pick roller as said pick engager is rotated by the drive shaft, said body being reversibly rotatable about said drive shaft; and said pick engager having a first rotational position relative to said drive shaft for urging the stack away from the pick roller and further having a second rotational position relative to said drive shaft for releasing the stack to its first position toward the pick roller when the pick roller is rotated to a stack engaging position;

said drive shaft including a flat peripheral surface; and said transverse aperture having a first surface adapted for engaging said flat peripheral drive shaft surface when said pick engager is in its first rotational position relative to said drive shaft, and having a second surface adapted for engaging said flat peripheral drive shaft surface when said pick engager is in its second rotational position relative to said drive shaft.

6. An apparatus according to claim 5 further comprising a plurality of pick rollers drivably connected to said drive shaft, and further comprising a plurality of pick engagers drivably connected to said drive shaft.

7. An apparatus according to claim 5 wherein said pick engager is rotated to said second rotational position relative to the drive shaft in response to a force exerted directly on said pick engager by the paper stack.

8. An apparatus according to claim 5 wherein said raised peripheral portion includes a roller for rollingly engaging the stack when said pick engager is rotated by the drive shaft.

9. A printer comprising:

means for forming an image on a sheet;

means for supporting a stack of sheets;

means for picking a top sheet from the stack, said picking means including:

a rotatable drive shaft;

a pick roller drivably connected to said drive shaft and having a peripheral surface for engaging the stack and picking the top sheet therefrom when rotated by said drive shaft;

urging means for biasing the stack toward a first position whereat the first sheet is frictionally engageable with the pick roller when the pick roller is rotated;

a pick engager drivably connected to said drive shaft, said pick engager including a body having a transverse aperture for drivably receiving the rotatable drive shaft, and further including a raised peripheral portion for urging the stack to a second position spaced apart from the pick roller when said pick engager is rotated by the drive shaft, said body being reversibly rotatable about said drive shaft; and said pick engager being rotatable about the drive shaft from a first rotational position to a second rotational position relative to the drive shaft for releasing said stack to its first biased position for engaging the top sheet against the pick roller when the drive shaft is rotated to a predetermined position;

said drive shaft including a flat peripheral surface; and said transverse aperture having a first surface adapted for engaging said flat peripheral drive shaft surface when said pick engager is in its first rotational position relative to said drive shaft, and having a second surface adapted for engaging said flat peripheral drive shaft surface when said pick engager is in its second rotational position relative to said drive shaft.

10. A printer according to claim 9 further comprising a plurality of pick engagers drivably connected to said drive shaft.

11. An apparatus according to claim 9 wherein said pick engager is rotated to said second rotational position relative to the drive shaft in response to a force exerted directly on said pick engager by the paper stack.

12. An apparatus according to claim 9 wherein said cam comprises a roller for rollingly engaging said paper stack when said pick engager is rotated by the drive shaft.

13. A method of picking a sheet of paper from a stack of sheets comprising the steps of:

biasing a stack of sheets toward a first position whereat a top sheet of the stack is frictionally engageable by a pick roller when the pick roller is rotated to a stack engaging position;

urging the stack to a second position spaced apart from said pick roller;

rotating said pick roller to said stack engaging position; and releasing said stack to said first position for frictionally engaging said top sheet with said pick roller for picking said top sheet from the stack;

the steps of urging the stack to said second position and releasing said stack to said first biased position comprise:

providing a rotatable drive shaft having a pick engager mounted thereon, said pick engager having a body including a transverse aperture therethrough for drivably receiving said drive shaft, and having a raised peripheral portion for urging the stack to a second position spaced apart from said pick roller when said pick engager is rotated; and said pick engager being rotatable about the drive shaft from a first rotational position to a second rotational position relative to the drive shaft for releasing said stack to its first biased position for engaging the top sheet with the pick roller when the pick roller is rotated to a predetermined position;

providing said drive shaft with a flat peripheral surface; and providing said transverse aperture with a first surface adapted for engaging said flat peripheral drive shaft surface when said pick engager is in its first rotational position relative to said drive shaft, and a second surface adapted for engaging said flat peripheral drive shaft surface when said pick engager is in its second rotational position relative to said drive shaft.

14. The method of claim 13 wherein the step of releasing said stack to said first biased position includes the steps of:

rotating the drive shaft, thereby engaging the raised peripheral surface of said pick engager against the stack and urging the stack to its second position;

rotating the pick roller to said predetermined picking position; and rotating said pick engager about the drive shaft to said second rotational position for disengaging the raised peripheral surface from the stack, thereby releasing the stack to its first biased position and engaging the pick roller with the top sheet of the stack.

15. The method of claim 14 wherein the step of rotating said pick engager about the drive shaft to said second rotational position includes urging the paper stack against said pick engager to exert a rotating force thereon.

* * * * *